US008022790B2

(12) United States Patent
Iguchi

(10) Patent No.: US 8,022,790 B2
(45) Date of Patent: Sep. 20, 2011

(54) COMPOSITE RIGHT/LEFT-HANDED LINE DEVICE

(75) Inventor: Daisuke Iguchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 248 days.

(21) Appl. No.: 12/506,804

(22) Filed: Jul. 21, 2009

(65) Prior Publication Data

US 2010/0019863 A1 Jan. 28, 2010

(30) Foreign Application Priority Data

Jul. 22, 2008 (JP) ..... 2008-188633

(51) Int. Cl.
*H01Q 1/38* (2006.01)

(52) U.S. Cl. ..... 333/185; 343/700 MS

(58) Field of Classification Search ..... 333/185, 333/219; 343/700 MS
See application file for complete search history.

(56) References Cited

U.S. PATENT DOCUMENTS

| | | | | |
|---|---|---|---|---|
| 6,958,729 | B1 * | 10/2005 | Metz | 343/700 MS |
| 7,750,869 | B2 * | 7/2010 | Mosallaei | 343/911 R |
| 7,839,236 | B2 * | 11/2010 | Dupuy et al. | 333/136 |
| 7,911,386 | B1 * | 3/2011 | Itoh et al. | 343/700 MS |
| 2006/0208957 | A1 | 9/2006 | Iizuka | |
| 2009/0174609 | A1 * | 7/2009 | Sanada | 343/700 MS |

FOREIGN PATENT DOCUMENTS

| | | | |
|---|---|---|---|
| EP | 1860724 | A1 | 11/2007 |
| JP | 2006-245984 | A | 9/2006 |
| JP | 2006-295873 | A | 10/2006 |
| JP | 2007-174519 | A | 7/2007 |

OTHER PUBLICATIONS

Kodera et al., "Comparison of Various Ferrite-Loaded CRLH Leaky-Wave Antenna Structures", Microwave Conf., 2008, APMC 2008, Dec. 16-20, 2008, pp. 1-4.*

Caloz, Christophe, et al: "A Novel Composite Right-/Left-Handed Coupled-Line Directional Coupler With Arbitrary Coupling Level and Broad Bandwidth," IEEE Transactions on Microwave Theory and Techniques, vol. 52, No. 3, Mar. 2004, p. 980-992.

* cited by examiner

*Primary Examiner* — Seungsook Ham
(74) *Attorney, Agent, or Firm* — Sughrue Mion, PLLC

(57) ABSTRACT

A composite right/left-handed line device includes plural electrodes, plural dielectric substances and plural magnetic substances. The plurality of electrodes each include a pair of electrode plates, and a connection piece connected to the pair of electrode plates. The plurality of electrodes are disposed at regular intervals in a thickness direction between a pair of input terminals and a pair of output terminals. The plurality of dielectric substances are interposed between opposite surfaces of the pairs of electrode plates of adjacent two of the electrodes. The plurality of magnetic substances are disposed adjacently to the dielectric substances, respectively. The plurality of magnetic substances are interposed between opposite surfaces of the connection pieces of adjacent two of the electrodes.

6 Claims, 11 Drawing Sheets

COMPOSITE RIGHT/LEFT-HANDED LINE DEVICE

CROSS-REFERENCE TO RELATED APPLICATIONS

This application is based on and claims priority under 35 USC 119 from Japanese Patent Application No. 2008-188633 filed on Jul. 22, 2008.

BACKGROUND

1. Technical Field

The present invention relates to a composite right/left-handed line device.

2. Related Art

Normally, a line propagating a magnetic wave serves as an equivalent circuit in which series inductance (L) components and parallel capacitance (C) components with respect to the line are connected continuously. This equivalent circuit is referred to as a "right-handed" (RH) system because the electric field, the magnetic field and the wave vector of the equivalent circuit follow the Fleming's right-hand rule. On the contrary, a circuit formed by reversing the L and C components artificially, that is, an equivalent circuit in which series capacitance components and parallel inductance components with respect to the line are connected continuously is referred to as "left-handed" (LH) system because the electric field, the magnetic field and the wave vector of the equivalent circuit follow the Fleming's left-hand rule. The left-handed system can obtain reverse frequency characteristic to that of the right-handed system. Therefore, the left-handed system has started to be applied, for example, to a miniature antenna, an antenna matching circuit, etc.

Media negative in both dielectric constant $\in$ and magnetic permeability $\mu$ are also referred to as "metamaterials" or "left-handed media". These media exhibit unique properties such as backward wave (wave whose energy propagation velocity (group velocity) and phase velocity have opposite signs) characteristic, lens effect, etc. Therefore, various applications of these media have been proposed recently as propagation and scattering properties of the media are found out.

SUMMARY

According to an aspect of the invention, a composite right/left-handed line device includes plural electrodes, plural dielectric substances and plural magnetic substances. The plurality of electrodes each include a pair of electrode plates, and a connection piece connected to the pair of electrode plates. The plurality of electrodes are disposed at regular intervals in a thickness direction between a pair of input terminals and a pair of output terminals. The plurality of dielectric substances are interposed between opposite surfaces of the pairs of electrode plates of adjacent two of the electrodes. The plurality of magnetic substances are disposed adjacently to the dielectric substances, respectively. The plurality of magnetic substances are interposed between opposite surfaces of the connection pieces of adjacent two of the electrodes.

DETAILED DESCRIPTION

A composite right/left-handed line device according to an exemplary embodiment of the invention includes plural electrodes, plural dielectric substances and plural magnetic substances. Each of the electrodes includes a pair of electrode plates, and a connection piece connected to the pair of electrode plates. The plural electrodes are disposed at regular intervals in a thickness direction between a pair of input terminals and a pair of output terminals. The plural dielectric substances are disposed to form multiple layers. Each of the dielectric substances is interposed between opposite surfaces of the pairs of electrode plates of adjacent two of the electrodes. The plural magnetic substances are disposed adjacently to the dielectric substances, respectively. The plural magnetic substances are disposed to form multiple layers. Each of the magnetic substances is interposed between opposite surfaces of the connection pieces of adjacent two of the electrodes.

In the composite right/left-handed line device, suitable materials can be selected respectively for the dielectric substances and the magnetic substances in accordance with a frequency domain to be used, and the shapes of the dielectric substances and the magnetic substances can be determined in accordance with capacitors and inductors requested per unit length.

In the above configuration, the dielectric substances provided in multiple layers form capacitors that are connected in series between the input terminals and the output terminals and the magnetic substances form inductors that are connected in parallel between lines. In this manner, a small-size composite right/left-handed line device can be formed.

First Exemplary Embodiment

Figure 1:
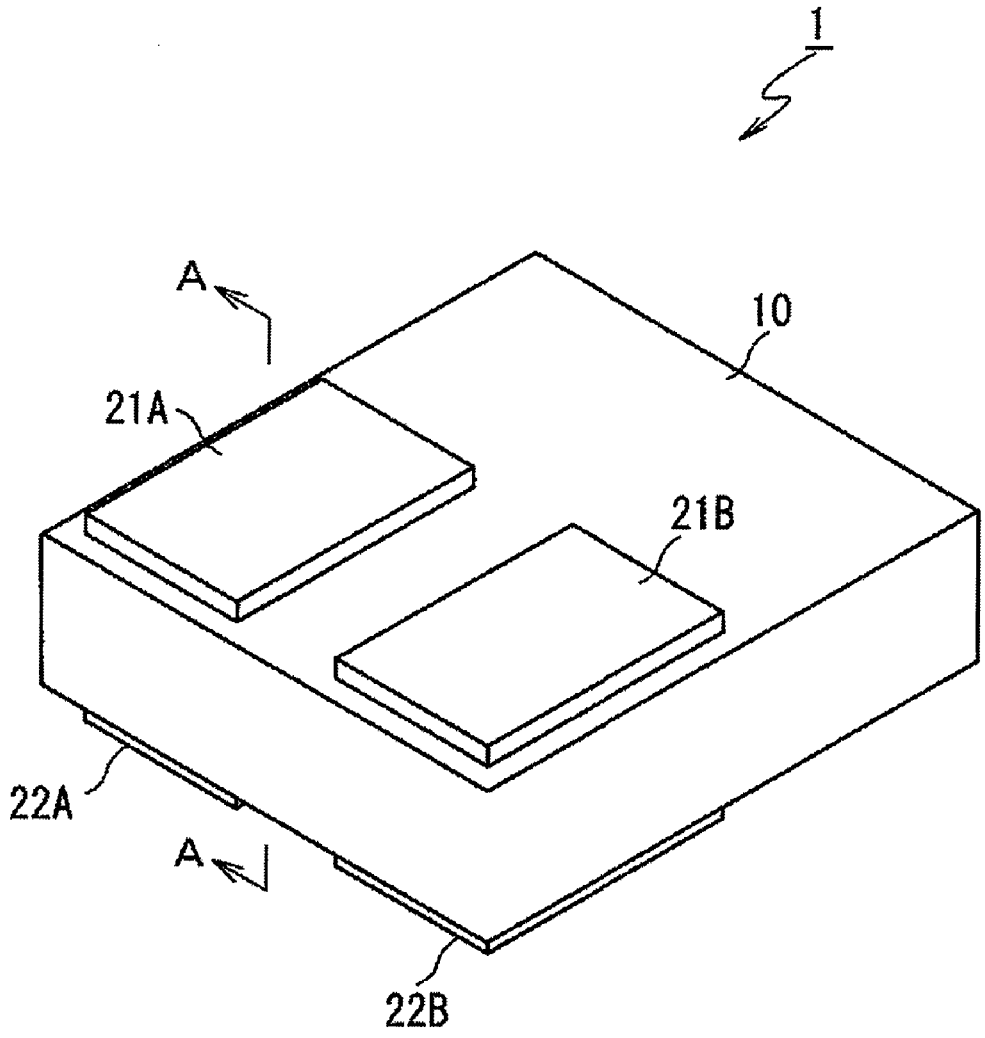
FIG. 1 is a perspective view showing a CRLH (Composite Right/Left-Handed) line device according to a first exemplary embodiment of the invention.

FIG. 1 is a perspective view showing a CRLH line device according to a first exemplary embodiment of the invention.

Figure 2A:
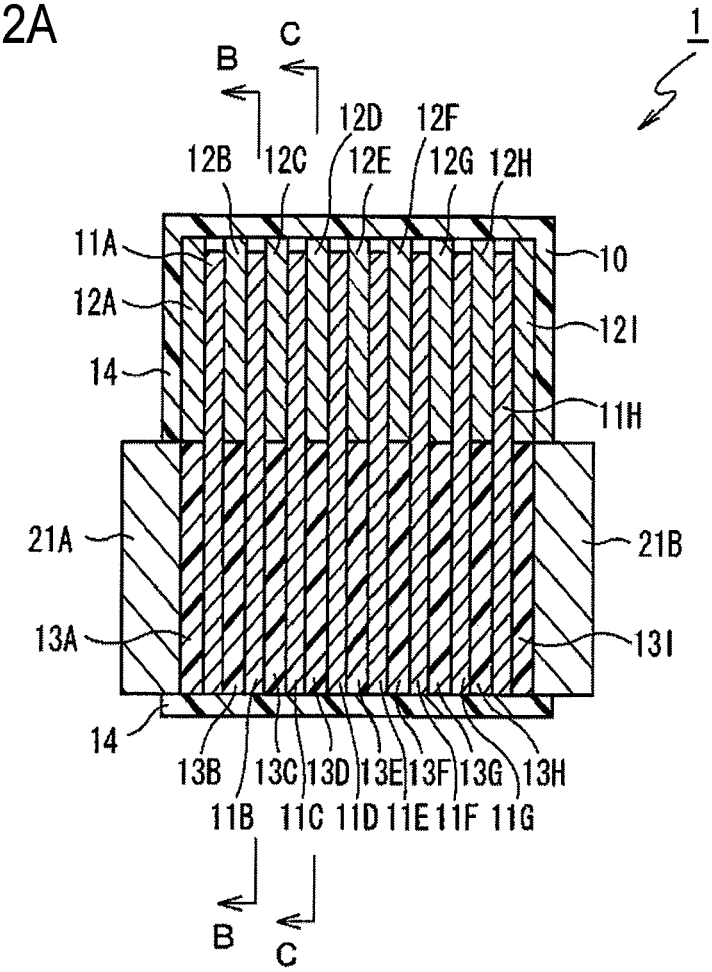
FIG. 2A is a sectional view of the CRLH line device shown in FIG. 1, taken along line A-A of FIG. 1.
Figure 2B:
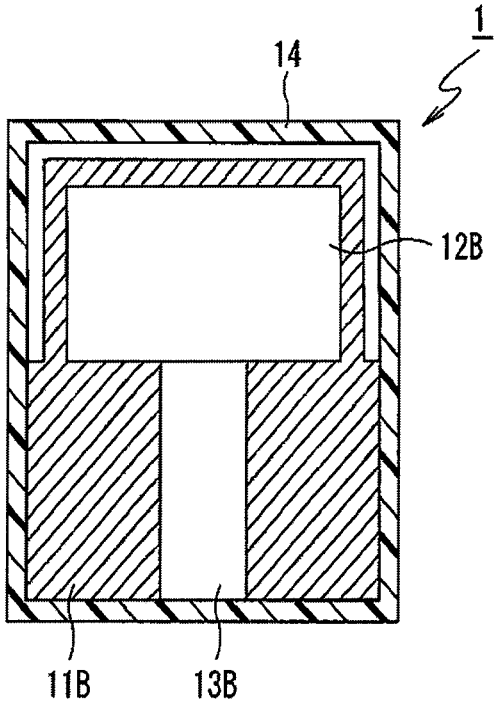
FIG. 2B is a sectional view of the same taken along line B-B of FIG. 2A.
Figure 2C:
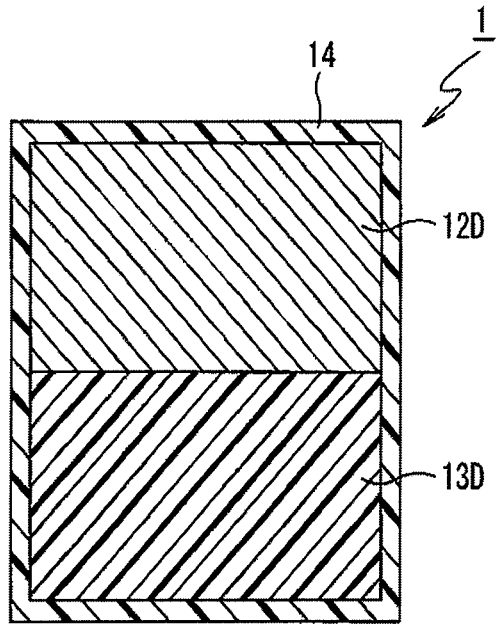
FIG. 2C is a sectional view of the same taken along line C-C of FIG. 2A.

FIGS. 2A to 2C are sectional views of the CRLH line device shown in FIG. 1. FIG. 2A is a sectional view taken along line A-A of FIG. 1, FIG. 2B is a sectional view taken along line B-B of FIG. 2A and FIG. 2C is a sectional view taken along line C-C of FIG. 2A.

(Configuration of CRLH Line Device)

A CRLH line device (composite right/left-handed line device) 1 according to the first exemplary embodiment includes a body portion 10, terminals 21A and 21B, and terminals 22A and 22B as shown in FIG. 1. The body portion 10 has the configuration of a left-handed equivalent circuit. The terminals 21A and 21B and the terminals 22A and 22B are provided on opposite surfaces of the body portion 10. The CRLH line device 1 is formed into one chip. A space between the terminals 21A and 21B and the terminals 22A and 22B serves as a signal transmission space.

For example, the CRLH line device 1 is provided midway in a not-shown stacked pair line, etc. In the CRLH line device 1, the terminals 21A and 21B are used as input terminals while the terminals 22A and 22B are used as output terminals. Alternatively, the terminals 21A and 21B may be used as output terminals while the terminals 22A and 22B are used as input terminals.

As shown in FIG. 2A, the body portion 10 includes plural (eight in this exemplary embodiment) electrodes 11A to 11H, plural (nine in this exemplary embodiment) magnetic substances 12A to 12I, plural (nine in this exemplary embodiment) dielectric substances 13A to 13I and an insulating package 14. The electrodes 11A to 11H are formed into the same shape and disposed at predetermined intervals to overlap one another. The magnetic substances 12A to 12I are shaped like elongated plates and disposed in such a manner that the magnetic substances 12A to 12I and the electrodes 11A to 11H are laminated alternately. The dielectric substances 13A to 13I are shaped like elongated plates and disposed in such a manner that the dielectric substances 13A to 13I are laminated adjacently to the magnetic substances 12A to 12I, respectively and that the dielectric substances 13A to 13I and the electrodes 11A to 11H are laminated alternately between the terminals 21A and 21B and the terminals 22A and 22B. The insulating package 14 is provided to cover the opposite surfaces of the terminals 21A, 21B, 22A and 22B except exposed surfaces of the terminals 21A, 21B, 22A and 22B and to cover the entire side surfaces of the magnetic substances 12A to 12I and the dielectric substances 13A to 13I.

A combined inductance value and a combined capacitance value can be changed by increasing/decreasing the number of electrodes 11A to 11H, the number of magnetic substances 12A to 12I and the number of dielectric substances 13A to 13I by the same ratio.

Figure 3:
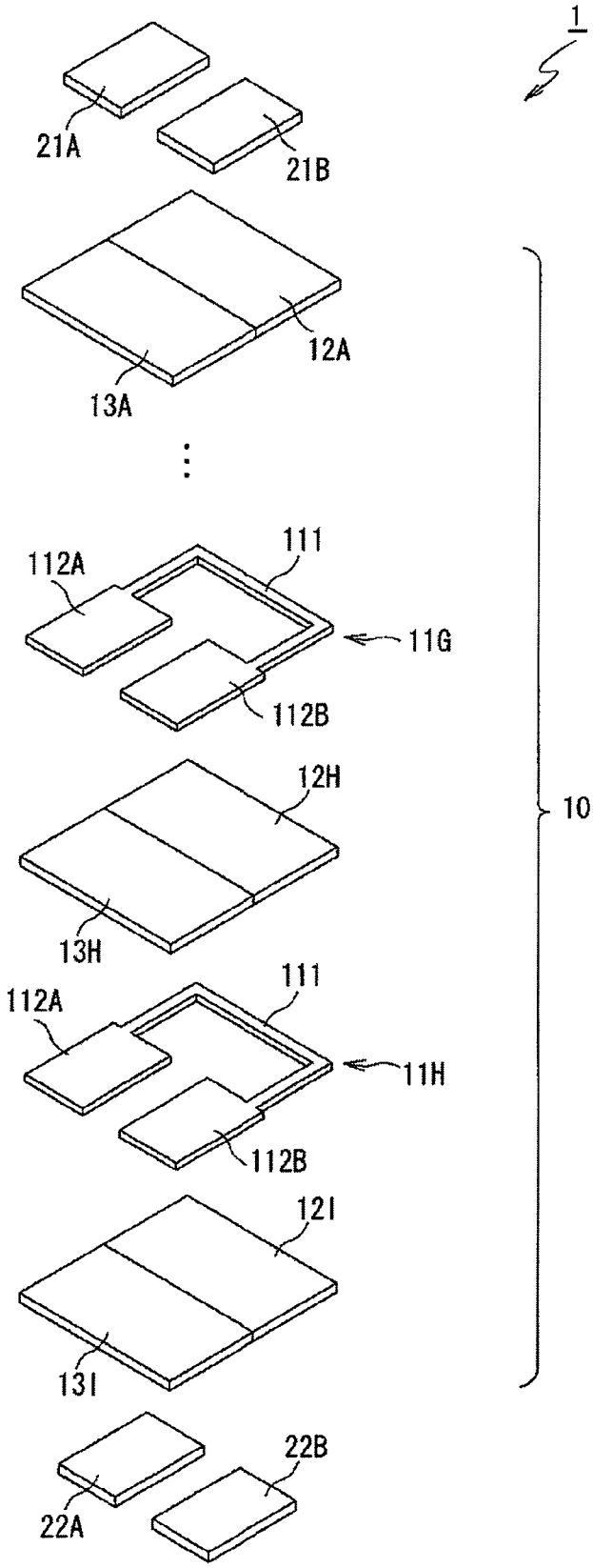
FIG. 3 is an exploded perspective view of the CRLH line device according to the first exemplary embodiment of the invention.

FIG. 3 is an exploded perspective view of the CRLH line device according to the first exemplary embodiment of the invention. In FIG. 3, illustration of the package is omitted. As shown in FIG. 3, each of the electrodes 11A to 11H includes a connection piece 111 and electrode portions 112A and 112B. The connection piece 111 is formed by bending a bar-shaped conductor into a "U" shape. The electrode portions 112A and 112B are shaped like flat plates. The electrode portions 112A and 112B are provided in opposite ends of the connection piece 111 and positioned to overlap the terminals 21A and 21B and the terminals 22A and 22B.

The electrodes 11A to 11H serve as electrode plates for the dielectric substances 13A to 13I, respectively. Each of the electrodes 11A to 11H is made of a conductive layer such as copper. Each of the electrodes 11A to 11H is independent of the others and is not electrically connected to any other electrode or any other member.

The magnetic substances 12A to 12I are layers made of a material, for example, obtained by sintering ferrite particles. The magnetic substances 12A to 12I are disposed so that each of the connection pieces 111 of the electrodes 11A to 11H is interposed between center portions, in a longitudinal direction, of adjacent two of the magnetic substances 12A to 12H. A combination of each of the magnetic substances 12A to 12I and the connection pieces 111 disposed oppositely thereto forms one inductor.

The dielectric substances 13A to 13I have substantially the same size as that of the magnetic substances 12A to 12I. For example, each of the dielectric substances 13A to 13I is a thin plate layer obtained by sintering barium titanate particles. The dielectric substances 13A to 13I overlap with the respective electrode portions (electrode plates) 112A and 112B of the electrodes 11A to 11H. As shown in FIGS. 2C and 3, each of the dielectric substances 13A to 13I is disposed to be level with an adjacent one of the magnetic substances 12A to 12H. A combination of each dielectric substance 13A to 13I and adjacent two of the electrodes 11A to 11H, which are disposed on the opposite surfaces of the dielectric substance 13A to 13I, forms one capacitor.

(Distributed Constant Circuit of CRLH Line Device)

Figure 4:
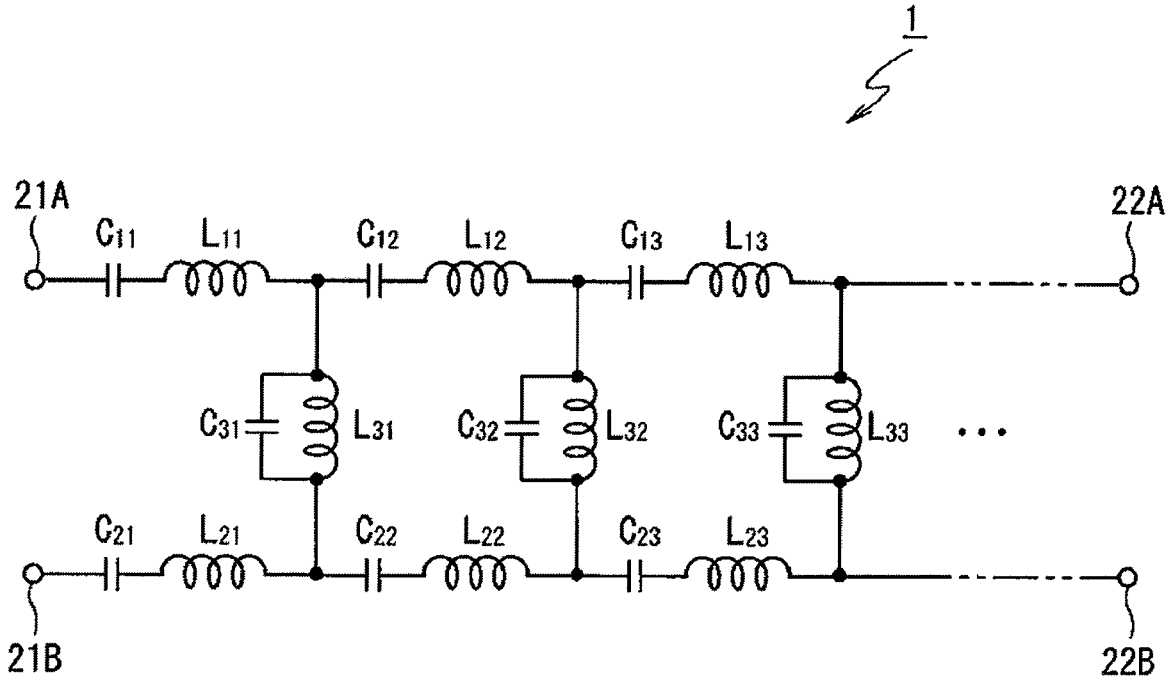
FIG. 4 is a distributed constant circuit diagram of the CRLH line device according to the first exemplary embodiment of the invention.

FIG. 4 is a distributed constant circuit diagram of the CRLH line device according to the first exemplary embodiment of the invention. Capacitors and inductors are connected alternately between the terminals 21A and 22A of the CRLH line device 1, as designated by $C_{11}$, $L_{11}$, $C_{12}$, $L_{12}$, $C_{13}$, $L_{13}$ . . . in FIG. 4. Similarly, capacitors and inductors are connected alternately between the terminals 21B and 22B of the CRLH line device 1, as designated by $C_{21}$, $L_{21}$, $C_{22}$, $L_{22}$, $C_{23}$, $L_{23}$ . . . in FIG. 4. Further, a parallel circuit having a capacitor $C_{31}$ and an inductor $L_{31}$ is connected between the inductors $L_{11}$ and $L_{21}$. A parallel circuit having a capacitor $C_{32}$ and an inductor $L_{32}$ is connected between the inductors $L_{12}$ and $L_{22}$.

In FIG. 4, a circuit including the capacitor $C_{11}$, the inductor $L_{11}$, the capacitor $C_{21}$, the inductor $L_{21}$, the capacitor $C_{31}$ and the inductor $L_{31}$, a circuit including the capacitor $C_{12}$, the inductor $L_{12}$, the capacitor $C_{22}$, the inductor $L_{22}$, the capacitor $C_{32}$ and the inductor $L_{32}$, and a circuit including the capacitor $C_{13}$, the inductor $L_{13}$, the capacitor $C_{23}$, the inductor $L_{23}$, the capacitor $C_{33}$ and the inductor $L_{33}$ indicate equivalent circuits per unit length. A distributed constant circuit is formed by generating such equivalent circuits in accordance with each unit length over an area ranging from the terminals 21A and 21B to the terminals 22A and 22B.

Of the equivalent circuits per unit length, a nearest equivalent circuit to the terminals 21A and 22A will be described by way of example. A circuit including the capacitors $C_{11}$ and $C_{21}$ and the inductor $L_{31}$ belongs to a left-handed system, and a circuit including the inductors $L_{11}$ and $L_{21}$ and the capacitor $C_{31}$ belongs to a right-handed system. The combination of the left-handed system and the right-handed system forms a CRLH line.

(Analysis Model and Analysis Result)

Figure 5:
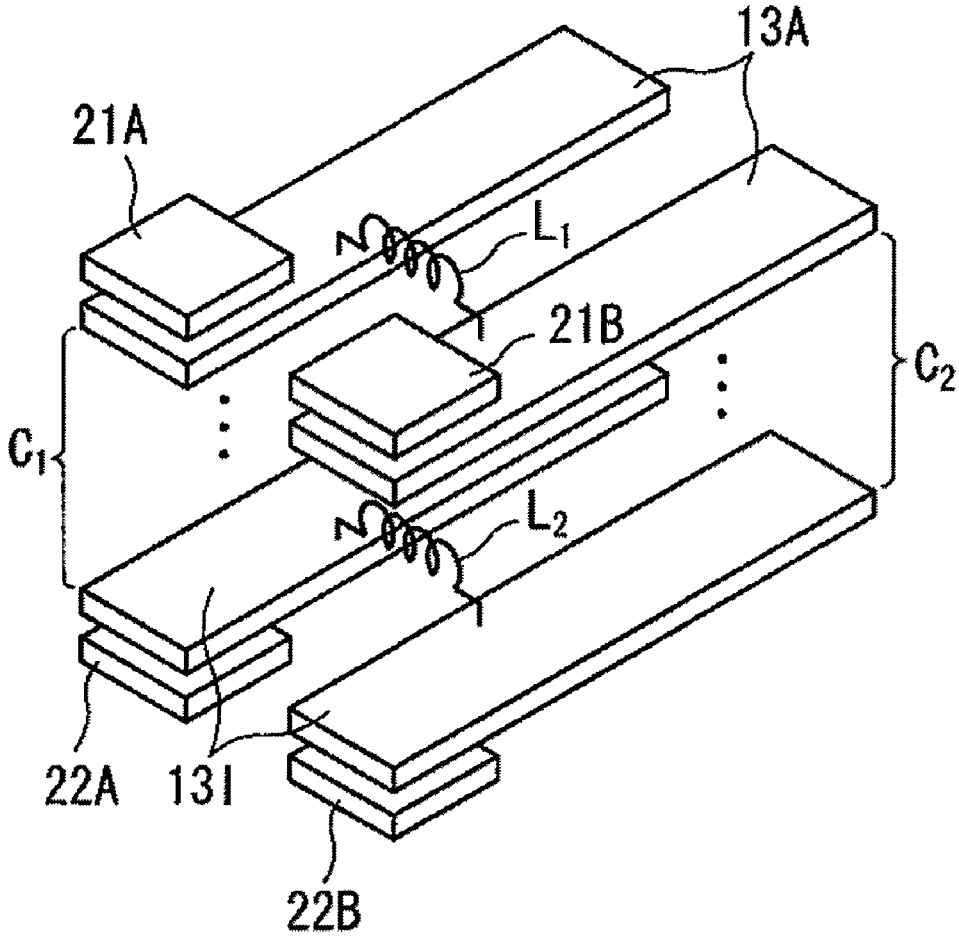
FIG. 5 is a view showing an analysis model of the CRLH line device according to the first exemplary embodiment of the invention.
Figure 6:
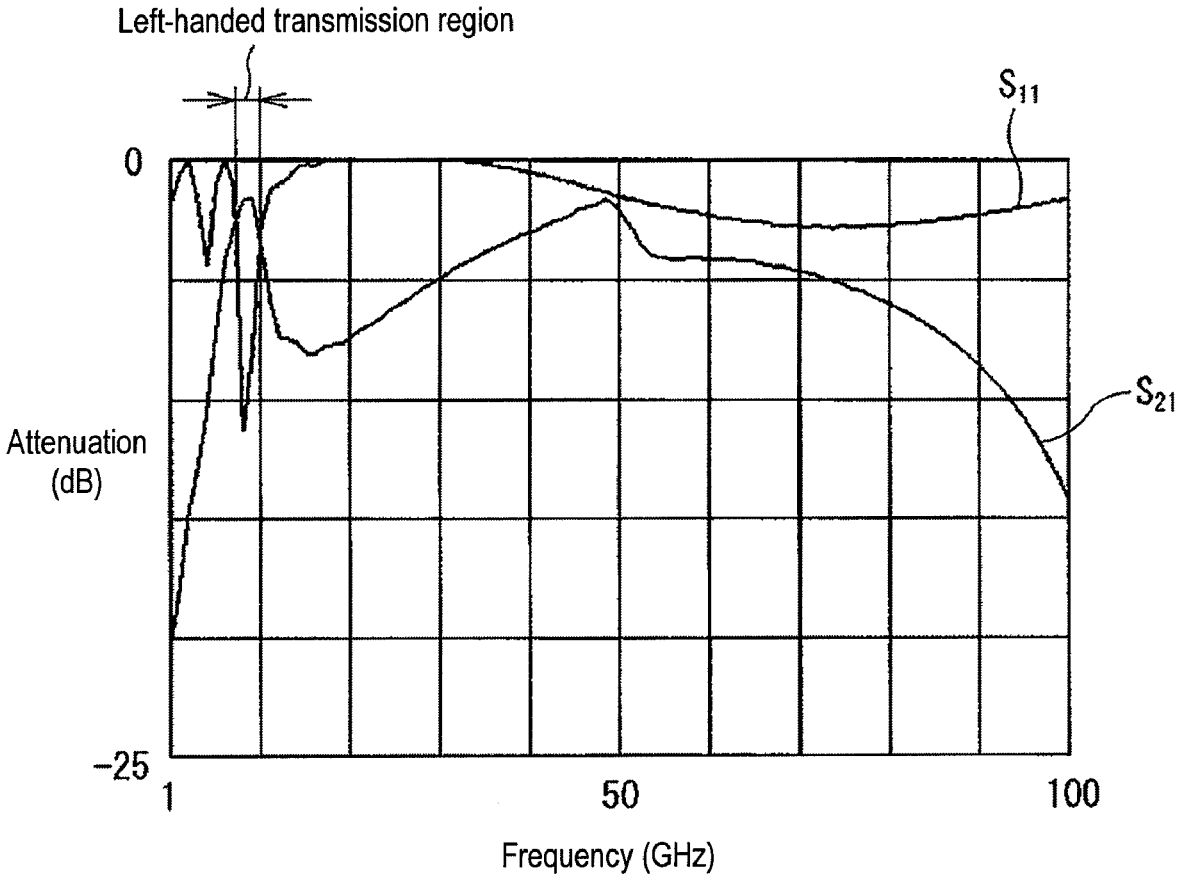
FIG. 6 is a graph showing transmission characteristics of the analysis model of FIG. 5.

FIG. 5 is a view showing an analysis model of the CRLH line device according to the first exemplary embodiment of the invention. FIG. 6 is a graph showing transmission characteristics of the analysis mode of FIG. 5. In FIG. 6, $S_{11}$ denotes an input reflection coefficient characteristic, and $S_{21}$ denotes a forward transmission function characteristic. The lower the level of $S_{11}$ is or the higher the level of $S_{21}$ is, the better the characteristic is.

As shown in FIG. 5, the analysis model has combined capacitances $C_1$(F) and $C_2$(F) made of the dielectric substances 13A to 13I between the terminals 21A and 22A and between the terminals 22A and 22B, a combined inductance $L_1$(H) of the inductors $L_{31}$ to $L_{33}$ . . . made of the magnetic substances 12A to 12I between the terminals 21A and 21B, and a combined inductance $L_2$(H) of the inductors $L_{31}$ to $L_{33}$ . . . made of the magnetic substances 12A to 12I between the terminals 22A and 22B.

Although this exemplary embodiment has been described with reference to the case where the CRLH line device 1 has the eight electrodes 11A to 11H, the analysis model of FIG. 5 includes ten layers of electrodes the size of each of which is set at 0.1×0.5 (mm). A relative dielectric constant of each of 11 layers of dielectric substances 13 is set at 4.0, and each inductor is set at 10 nH as a lumped constant inductor.

When the analysis model shown in FIG. 5 is analyzed under the aforementioned conditions, results shown in FIG. 6 are obtained. As shown in FIG. 6, it can be known that band-pass characteristics are exhibited near 9 GHz which belongs to a left-handed transmission region.

Second Exemplary Embodiment

Figure 7:
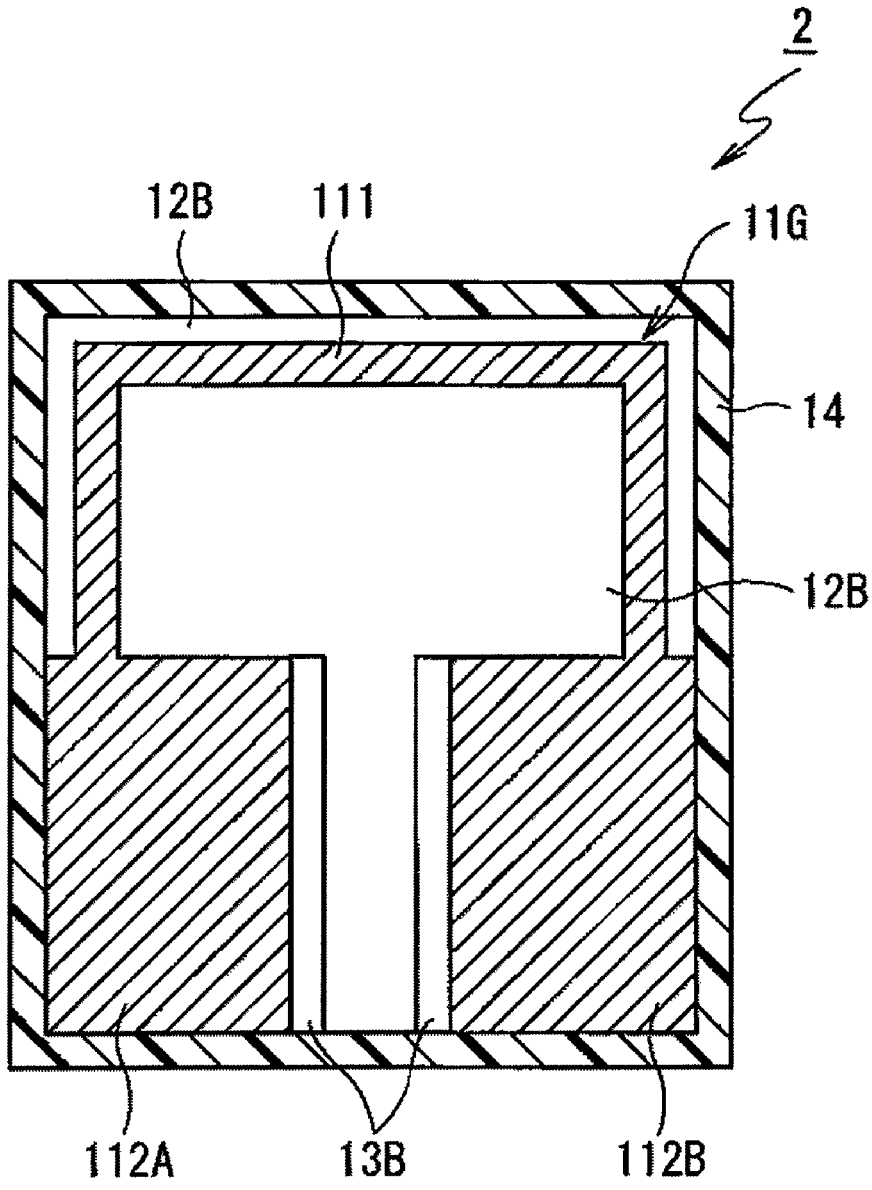
FIG. 7 is a sectional view showing a CRLH line device according to a second exemplary embodiment of the invention.
Figure 8:
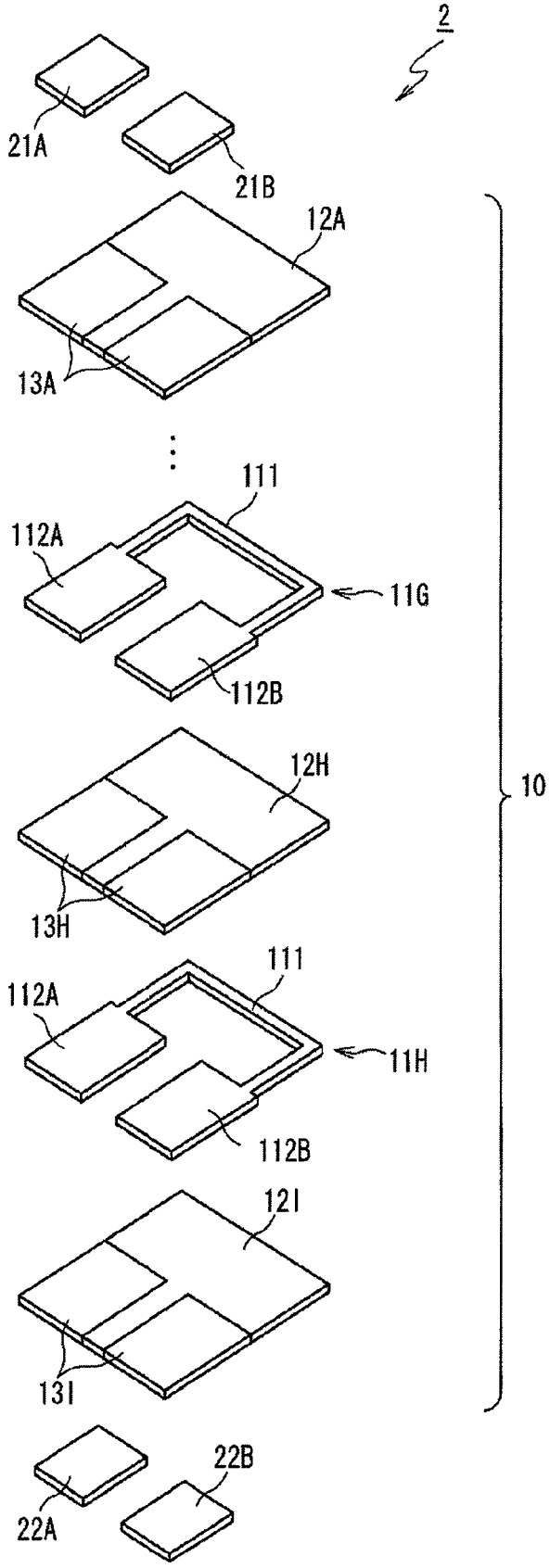
FIG. 8 is an exploded perspective view of the CRLH line device according to the second exemplary embodiment of the invention.

FIG. 7 is a sectional view showing a CRLH line device according to a second exemplary embodiment of the invention. FIG. 8 is an exploded perspective view of the CRLH line device according to the second exemplary embodiment of the invention. FIG. 7 corresponds to the sectional view taken along line B-B of FIG. 2A in the first exemplary embodiment. In FIG. 8, illustration of a package is omitted.

A CRLH line device (Composite Right/Left-Handed line device) 2 according to the second exemplary embodiment is configured in such a manner that each magnetic substance 12A to 12I in the first exemplary embodiment is formed like a "T" shape and two split parts of each dielectric substance 13A to 13H are disposed on opposite sides of the "T" portion of the magnetic substance 12A to 12I. In this manner, the split parts of the electrode are isolated so as to suppress the right-handed system. The remaining configuration of the second exemplary embodiment is the same as that of the first exemplary embodiment.

Third Exemplary Embodiment

Figure 9:
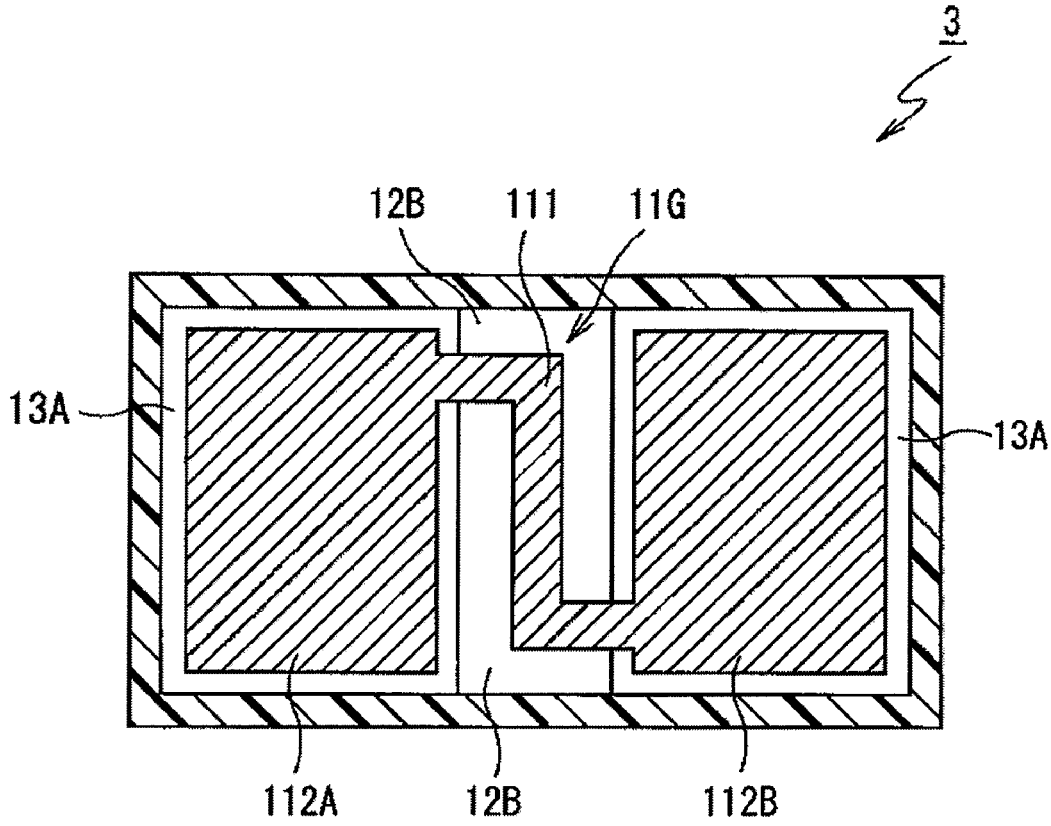
FIG. 9 is a sectional view showing a CRLH line device according to a third exemplary embodiment of the invention.
Figure 10:
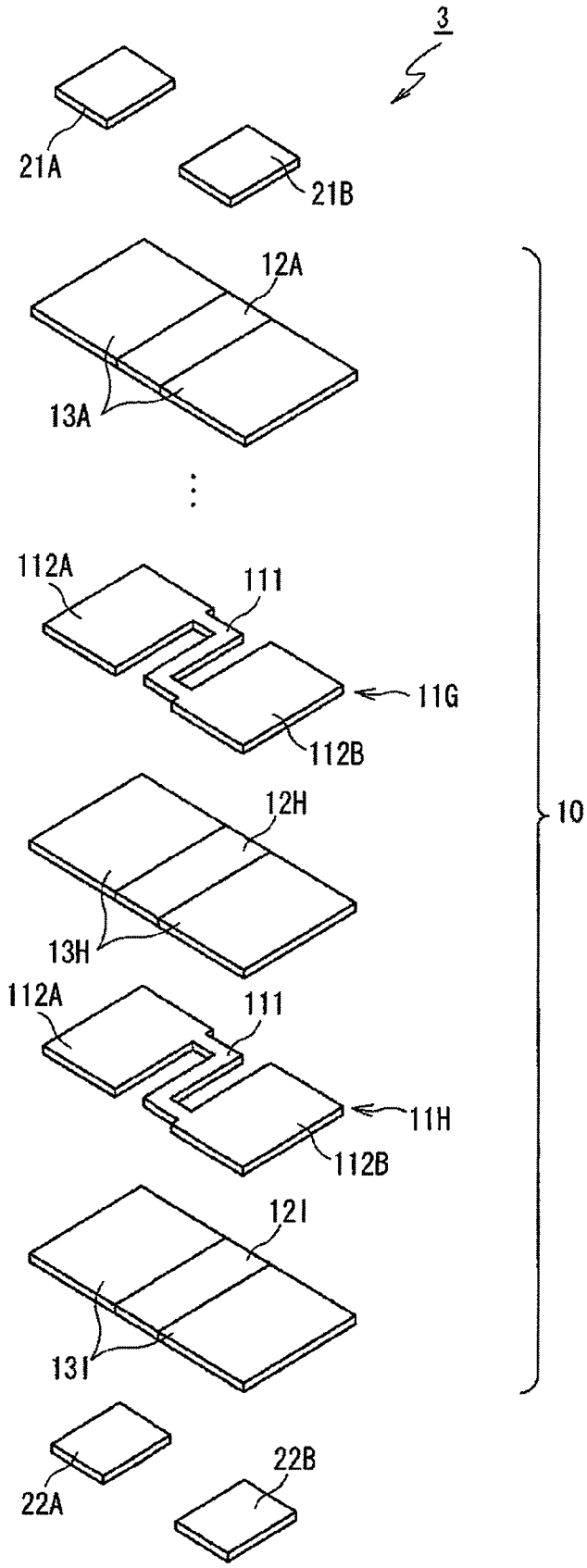
FIG. 10 is an exploded perspective view of the CRLH line device according to the third exemplary embodiment of the invention.

FIG. 9 is a sectional view showing a CRLH line device according to a third exemplary embodiment of the invention. FIG. 10 is an exploded perspective view of the CRLH line device according to the third exemplary embodiment of the invention. FIG. 9 corresponds to the sectional view taken along line B-B of FIG. 2A in the first exemplary embodiment. In FIG. 10, illustration of a package is omitted.

A CRLH line device (Composite Right/Left-Handed line device) 3 according to the third exemplary embodiment is configured in such a manner that the size of each magnetic substance 12A to 12I in the first exemplary embodiment is reduced and each dielectric substance 13A to 13I is split into two parts so that the two split parts of the dielectric substance 13A to 13I are located on opposite sides of the magnetic substance 12A to 12I. In this manner, each capacitance can be made larger than that in the first exemplary embodiment. The remaining configuration of the third exemplary embodiment is the same as that of the first exemplary embodiment. Since the shape and disposition of each magnetic substance 12A to 12I are made different from those in the first exemplary embodiment, the connection piece 111 of each electrode 11A to 11H is formed like a "Z" shape.

Fourth Exemplary Embodiment

Figure 11:
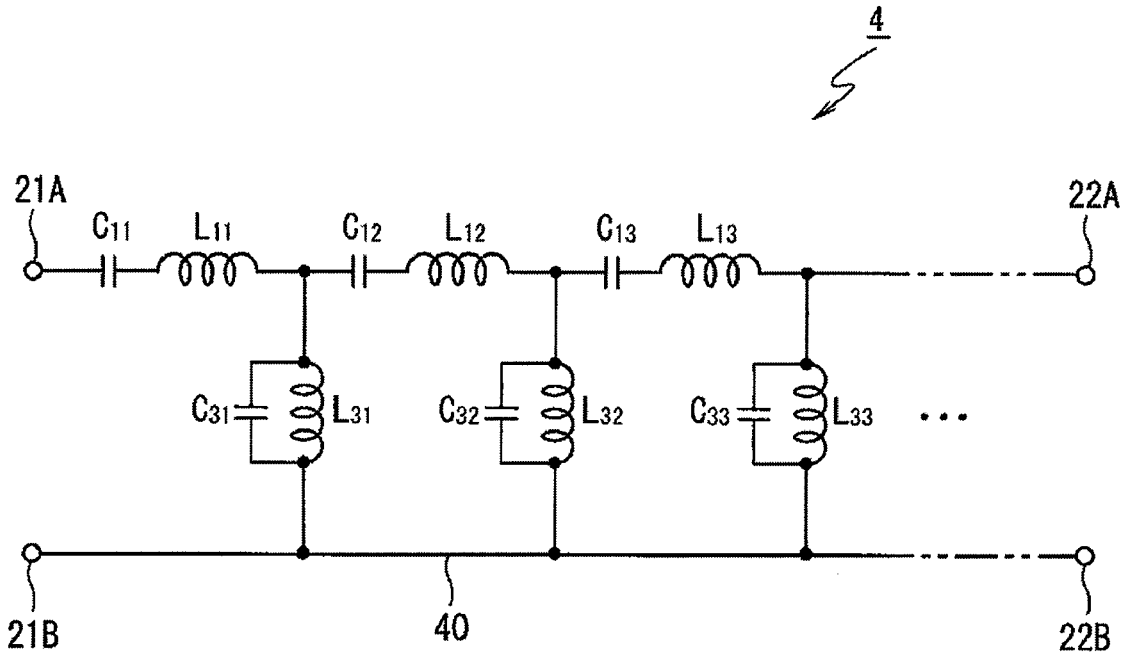
FIG. 11 is a distributed constant circuit diagram of a CRLH line device according to a fourth exemplary embodiment of the invention.

FIG. 11 is a distributed constant circuit diagram of a CRLH line device according to a fourth exemplary embodiment of the invention. The embodiment provides a CRLH line device (Composite Right/Left-Handed line device) 4 suitable to be mounted on a substrate in which one signal line and a ground layer form a transmission line. The CRLH line device 4 is a distributed constant circuit obtained by removing the capacitors $C_{21}$, $C_{22}$, $C_{23}$, . . . and the inductors $L_{21}$, $L_{22}$, $L_{23}$, . . . between the terminals 21B and 22B, i.e. the C and L between the terminals 21B and 22B, from FIG. 4 according to the first exemplary embodiment and replacing the line with one conductor 40.

Other Exemplary Embodiments

The invention is not limited to the respective aforementioned embodiments. Various modifications can be made as long as the gist of the invention is not changed. For example, constituent parts of the respective embodiments can be combined desirably.

In the respective embodiments, each dielectric substance 13A to 13I and each magnetic substance 12A to 12I are made to have the same thickness. Alternatively, the dielectric substance 13A to 13I and the magnetic substance 12A to 12I may be made to have different thicknesses. Further, in the respective embodiments, each dielectric substance 13A to 13I and each magnetic substance 12A to 12I located in the same layer are disposed on one and the same plane. Alternatively, the dielectric substance 13A to 13I and the magnetic substance 12A to 12I may be disposed at different heights.

Although each embodiment has been described as application to a band-pass filter by way of example as shown in FIG. 6, the invention can be applied to any filter other than the band-pass filter, a backward radiation antenna, an ultra-low-frequency zero-order oscillator, etc.

As set forth above, the foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A composite right/left-handed line device comprising:

a plurality of electrodes each including a pair of electrode plates, and a connection piece connected to the pair of electrode plates, the plurality of electrodes that are disposed at regular intervals in a thickness direction between a pair of input terminals and a pair of output terminals;

a plurality of dielectric substances that are interposed between opposite surfaces of the pairs of electrode plates of adjacent two of the electrodes; and a plurality of magnetic substances that are disposed adjacently to the dielectric substances, respectively, the plurality of magnetic substances that are interposed between opposite surfaces of the connection pieces of adjacent two of the electrodes.

2. The composite right/left-handed line device according to claim 1, wherein the pair of electrode plates of each electrode are formed in a square plate form, and the connection piece of each electrode has a bent portion.

3. The composite right/left-handed line device according to claim 1, where each of the dielectric substances is constituted by a single plate-like dielectric substance.

4. The composite right/left-handed line device according to claim 1, where each of the dielectric substances is constituted by two isolated plate-like dielectric substances disposed on opposite sides of a corresponding one of the magnetic substances.

5. The composite right/left-handed line device according to claim 1, wherein each of the magnetic substances is formed in a plate shape, and the connection piece, corresponding to each of the magnetic substances, is disposed along a center portion of each of the magnetic substances.

6. A composite right/left-handed line device comprising:

a plurality of electrodes each including electrode plates, and a connection piece connected to the electrode plates, the plurality of electrodes that are disposed at regular intervals in a thickness direction between an input terminal and a ground layer;

a plurality of dielectric substances that are interposed between opposite surfaces of the electrode plates of adjacent two of the electrodes;

a plurality of magnetic substances that are disposed adjacently to the dielectric substances, respectively, the plurality of magnetic substances that are interposed between opposite surfaces of the connection pieces of adjacent two of the electrodes; and a conductor that connects the respective connection pieces to the ground layer.

* * * * *